US006725142B2

(12) United States Patent
Koch

(10) Patent No.: US 6,725,142 B2
(45) Date of Patent: Apr. 20, 2004

(54) CONTROL SYSTEM FOR A WORK MACHINE DIGGING ASSEMBLY

(75) Inventor: Roger D. Koch, Pekin, IL (US)

(73) Assignee: Caterpillar Inc, Peoria, IL (US)

( * ) Notice: Subject to any disclaimer, the term of this patent is extended or adjusted under 35 U.S.C. 154(b) by 69 days.

(21) Appl. No.: 10/190,732

(22) Filed: Jul. 9, 2002

(65) Prior Publication Data

US 2004/0010359 A1 Jan. 15, 2004

(51) Int. Cl.[7] ..... G06G 7/76

(52) U.S. Cl. ..... 701/50; 701/36; 414/695; 414/699

(58) Field of Search ..... 414/699, 694, 414/695.5, 695, 700, 698; 701/1, 50, 36; 172/2, 3, 4, 4.5

(56) References Cited

U.S. PATENT DOCUMENTS

| | | | |
|---|---|---|---|
| 3,835,949 | A | 9/1974 | Whelan |
| 3,846,781 | A | 11/1974 | Smith |
| 3,977,547 | A | 8/1976 | Holopainen |
| 3,999,670 | A | 12/1976 | Weyhausen |
| 4,288,196 | A | 9/1981 | Sutton, II |
| 4,393,607 | A | 7/1983 | Hirosawa |
| 4,572,527 | A | 2/1986 | Stafford-Mills et al. |
| 4,650,017 | A | 3/1987 | Pelletier et al. |
| 4,679,803 | A | 7/1987 | Biller et al. |
| 4,746,133 | A | 5/1988 | Hanser et al. |
| 4,848,010 | A | 7/1989 | Zimmerman |
| 4,934,463 | A | 6/1990 | Ishida et al. |
| 4,991,673 | A | 2/1991 | Ericsson |
| 5,159,989 | A | 11/1992 | Claxton |
| 5,337,847 | A | 8/1994 | Woods et al. |
| 5,551,518 | A | 9/1996 | Stratton |
| 5,596,826 | A | 1/1997 | Barden |
| 5,625,967 | A | 5/1997 | Kulle |
| 5,988,654 | A | 11/1999 | Wix et al. |
| 6,082,927 | A | 7/2000 | Dahlinger et al. |
| 6,158,539 | A | 12/2000 | Isley |
| 6,196,586 | B1 | 3/2001 | Messenger |
| 6,343,799 | B1 | 2/2002 | Moyer |

*Primary Examiner*—Richard M. Camby
(74) *Attorney, Agent, or Firm*—Finnegan, Henderson, Farabow, Garrett & Dunner

(57) ABSTRACT

A control system for orienting a swing axis of a work machine is disclosed. The work machine includes a swing frame and a frame structure, and the control system includes an operator interface configured to receive operator inputs, wherein the operator inputs represent a desired orientation of the swing axis of the swing frame. The control system also includes a sensor assembly configured to determine an actual orientation of the swing axis of the swing frame and a controller configured to compare the desired orientation to the actual orientation of the swing axis to determine a swing angle. The controller is adapted to output the swing angle. The swing axis may be adjusted by adjusting the work machine frame or by adjusting a frame assembly independent of the work machine frame.

35 Claims, 8 Drawing Sheets

CONTROL SYSTEM FOR A WORK MACHINE DIGGING ASSEMBLY

TECHNICAL FIELD

This invention relates generally to an automatic control system for a work machine. More particularly, the invention relates to an automatic system for orienting a swing axis of the work machine.

BACKGROUND

Excavating type machines, such as a backhoe loader, are versatile machines equipped with a work implement, such as a bucket mechanism, for grading slopes, digging trenches, and performing other excavations. These excavations are often in close proximity to buildings, sidewalks, or buried utilities.

On any ground or terrain, an operator must take care to properly orient the excavating type machine prior to beginning work or the machine will not dig with a clean horizontal surface. For instance, if the excavating type machine were leaning to one side on a flat surface, the bucket would dig in deeper at one corner of the bucket than the other. The ability to dig a vertical face or a ditch with a vertical wall is especially hindered by an out-of-level machine. An out-of-level machine can result in an out-of-level bucket that either digs a ditch with an angled face or creates a somewhat vertical face having jagged edges.

When an excavating type machine, such as a backhoe loader, is used to grade a slope, the backhoe is stationed in position at the top edge of the grade. The boom and bucket extend from the backhoe over the edge of the slope. An operator manipulates the bucket down onto the sloped ground to remove or distribute dirt along the slope. The boom and bucket are pivoted about a swing axis and extended to grade all accessible regions of the slope. During grading, the edge of the bucket maintains a proper roll position of being parallel to the plane of the graded slope only when the boom is pointing either directly down the slope or along the steepest gradient of the slope. If the boom pivots about the swing axis to any direction that is not directly down the slope or along the steepest gradient, the bucket edge will not be parallel to the slope face. As such, when grading or moving dirt, one edge of the bucket will dig in before the other edge, causing ridges in the dirt, instead of the desired flat surface.

Some excavating type machines are equipped with stabilizing arms configured to remove the weight of the machine from the machine tires and to stabilize the machine during the digging operation. These stabilizing arms are also used to level the machine. However, the leveling operation is typically only an approximation and is dependant on the judgment of the machine operator. If the operator's judgment is not good, the excavation may be angled considerably, which may result in damage to adjacent structures or to previously buried cables or pipelines.

One attempt to address the deficiencies described above is disclosed in U.S. Pat. No. 5,288,196 to Sutton, II, issued Feb. 23, 1999. The '196 patent discloses a computer controlled backhoe having a frame with an imaginary roll axis and a pitch axis. Two outriggers are used to level the frame relative to the roll axis with appropriate hydraulic actuators to move the outriggers. The system includes a dual axis gyro, which continuously senses the positions of the roll and pitch axes of the frame. The information is supplied to a computer, which compensates for changes in the frame position. The '196 patent, however, does not provide an automated control system capable of continuously adjusting the swing axis of a work machine digging assembly to a desired orientation.

The present invention is directed to overcoming one or more of the problems or disadvantages associated with the prior art.

SUMMARY OF THE INVENTION

One aspect of the present invention is a control system for orienting a swing axis of a work machine. The work machine includes a swing frame and a frame structure, and the control system includes an operator interface configured to receive operator inputs, wherein the operator inputs represent a desired orientation of the swing axis of the swing frame. The control system also includes a sensor assembly configured to determine an actual orientation of the swing axis of the swing frame and a controller configured to compare the desired orientation to the actual orientation of the swing axis to determine a swing angle. The controller is adapted to output the swing angle.

In another aspect of the invention, a method of orienting a swing axis of a work machine having a swing frame and a frame structure is disclosed. The method includes the steps of entering operator inputs into an operator interface, wherein the operator inputs represent a desired orientation of the swing axis of the swing frame, sensing the actual orientation of the swing axis, comparing the desired orientation to the actual orientation of the swing axis to determine a swing angle, and adjusting the swing axis based on the swing angle to obtain the desired orientation of the swing axis.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of the specification, illustrate exemplary embodiments of the invention and together with the written description, serve to explain the principles of the invention.

DETAILED DESCRIPTION

Embodiments of the present invention are now described with reference to the figures, where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention.

Figure 1:
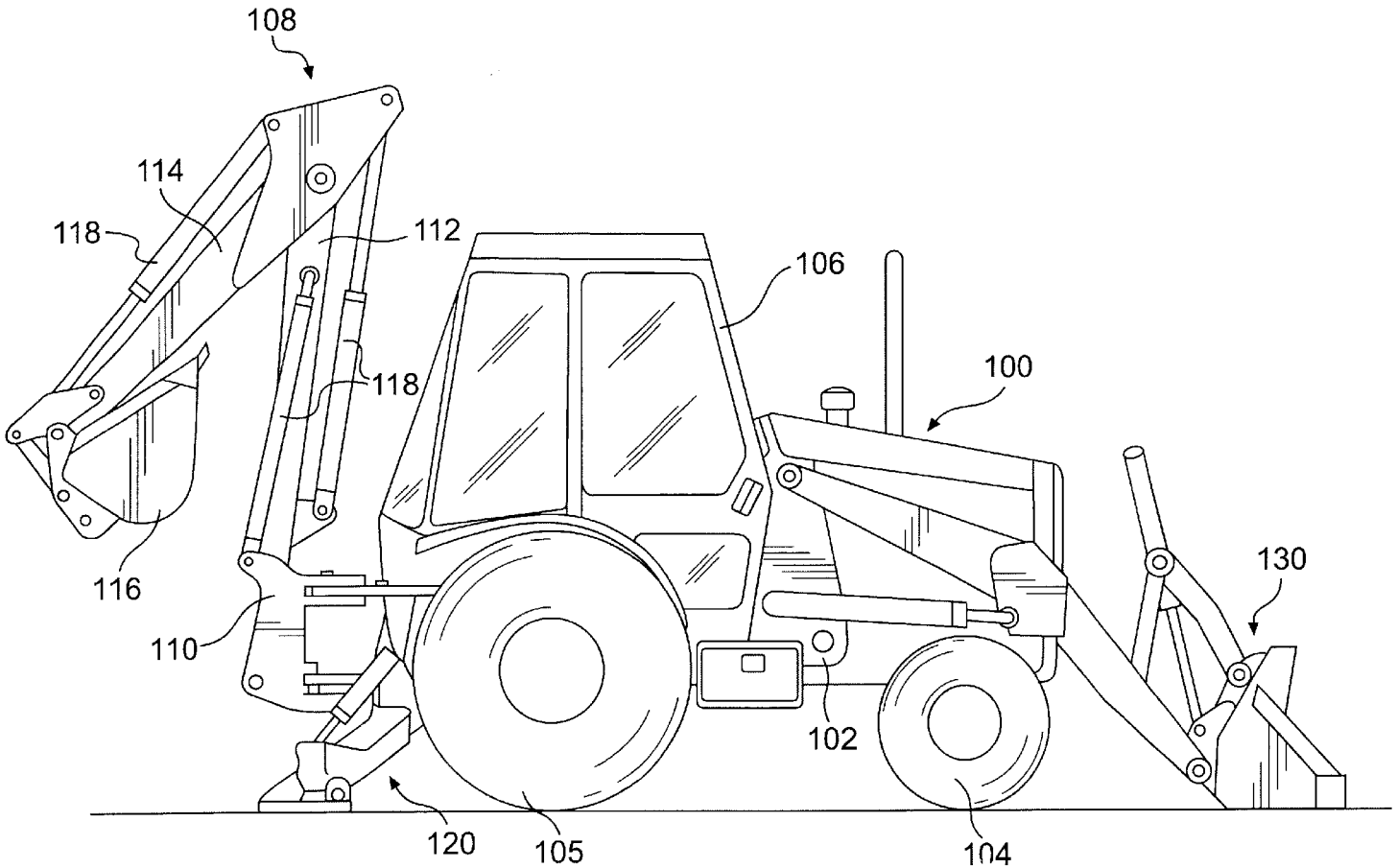
FIG. 1 is a diagrammatic side view of an exemplary embodiment of a work machine according to the invention.

With reference to FIG. 1, a work machine 100 for performing a variety of work functions includes a frame structure 102, an operator's compartment 106 supported on frame structure 102, and a digging assembly 108, which is supported by frame structure 102 and is typically connected to the rear portion of work machine 100.

Work machine 100 further includes front wheels 104 and rear wheels 105 for supporting the work machine 100. Work machine 100 could be of a type commonly referred to as a backhoe loader and may further include a front work implement assembly 130, such as a loader bucket assembly, which may be connected to frame structure 102 at the front portion of work machine 100. While the exemplary embodiment is shown as a backhoe loader, other types of work machines may utilize the present invention.

Digging assembly 108 includes a swing frame 110, a boom member 112, a stick member 114, and a work implement 116. Digging assembly 108 can be used, for example, to dig a hole or ditch, level the ground, or grade an area at a desired angle. Swing frame 110 may be connected to and supported by frame structure 102. Boom member 112 extends between swing frame 110 and stick member 114. Stick member 114 extends from boom member 112 to work implement 116. Work implement 116 is connected to an end of stick member 114.

Work implement 116 may be, for example, a bucket or shovel for picking up and moving dirt and soil, but may be any other implement, as would be apparent to one skilled in the relevant art. Actuators 118 extend between swing frame 110 and boom member 112, between boom member 112 and stick member 114, and between stick member 114 and work implement 116 to operate and manipulate boom member 112, stick member 114, and work implement 116. Actuators 118 are typically hydraulic powered cylinders, but may be other types of actuators as would be apparent to one skilled in the art.

Figure 2:
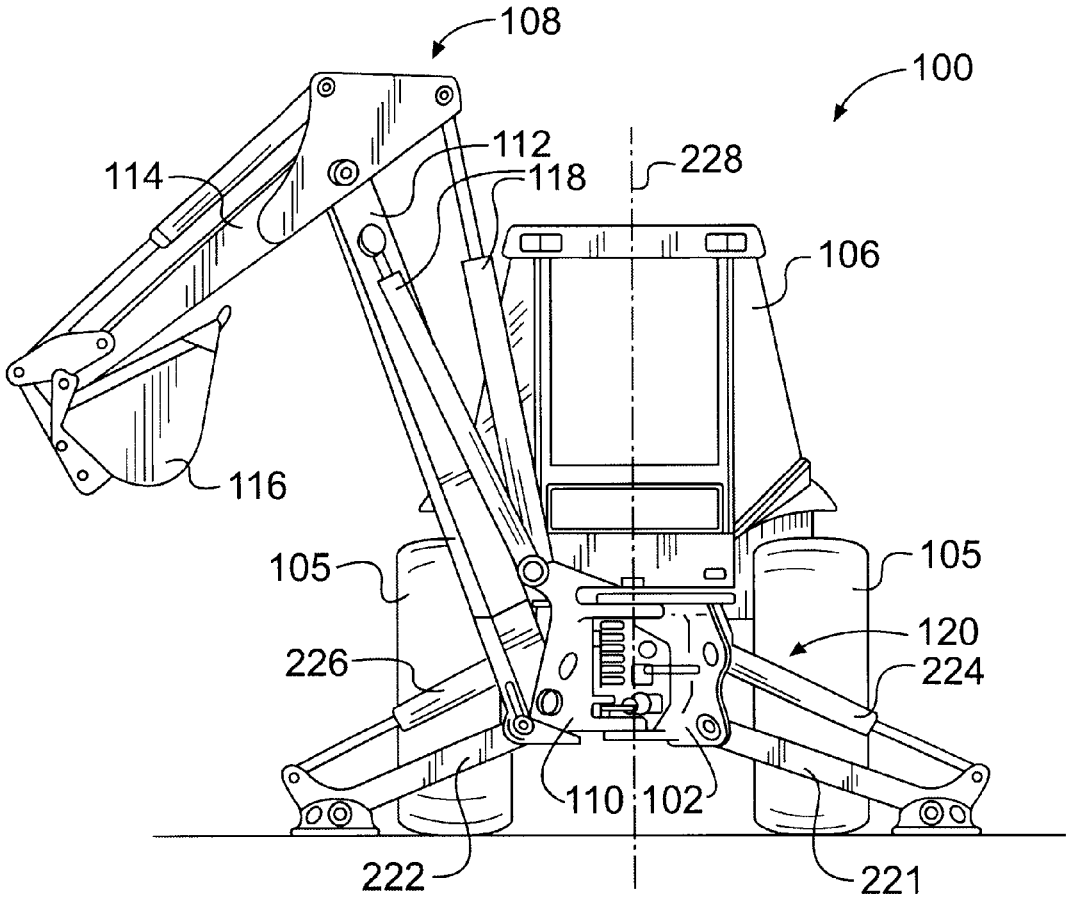
FIG. 2 is a rear view of the work machine of FIG. 1

Work machine 100 may include a stabilizing system 120 best seen in FIG. 2. Stabilizing system 120 of work machine 100 includes first and second stabilizing arms 221, 222 and respective first and second stabilizing actuators 224, 226. Stabilizing actuators may be hydraulic powered cylinders, but may be other types of actuators as would be apparent to one skilled in the art.

Stabilizing arms 221, 222 extend from frame structure 102 and are adapted to stabilize work machine 100 during a digging operation. Generally, because the tires on work machines are air-filled and compressible, application of large loads, as are applied by digging, lifting, and rotating digging assembly 108, can rock, bounce or otherwise move work machine 100 during a digging operation. Stabilizing arms 221, 222 can be used to remove the weight of work machine 100, as well as the weight of digging assembly 108 and any material carried by the digging assembly from rear wheels 105, thereby reducing the chance of bouncing or incremental displacement of the work machine. Furthermore, when the work implement carries heavy loads, extension of boom member 112 and stick member 114 provides an increasing cantilever load, which can cause work machine 100 to become unstable. Accordingly, stabilizing arms 221, 222 may extend beyond the width of rear wheels 105 to provide a wider base for stabilizing work machine 100.

Front work implement assembly 130 may be used to raise front wheels 104 from the ground, thereby eliminating bouncing of the front end of work machine 100. When front work implement assembly 130 is lowered in order to remove any load from front wheels 104 and stabilizing actuators 224, 226 are lowered to remove any load from the rear tires, work machine 100 is stabilized by a tripod-like three point balance system.

Stabilizing actuators 224, 226 operate by extending or retracting to control the placement of stabilizing arms 221, 222. By lengthening stabilizing actuators 224, 226, stabilizing arms 221, 222 are lowered to the ground, and frame structure 102 and rear wheels 105 can be lifted from the ground. By shortening stabilizing actuators 224, 226, stabilizing arms 221, 222 lower frame structure 102 and rear wheels 105 to the ground, and then stabilizing arms 221, 222 are lifted from the ground.

Stabilizing actuators 224, 226 may be separately actuated in order to allow individual setting of the stabilizing arms. As such, activating stabilizing actuators 224, 226 may also serve to tilt the work machine 100 and digging assembly 108 relative to the ground, thereby enabling an operator to orient the work machine at a desired tilt or angle.

Swing frame 110 of digging assembly 108 may rotate toward either side of work machine 100 about a swing axis 228. Accordingly, because swing frame 110 supports boom member 112, stick member 114 and work implement 116, all of digging assembly 108 rotates about swing axis 228.

Figure 3:
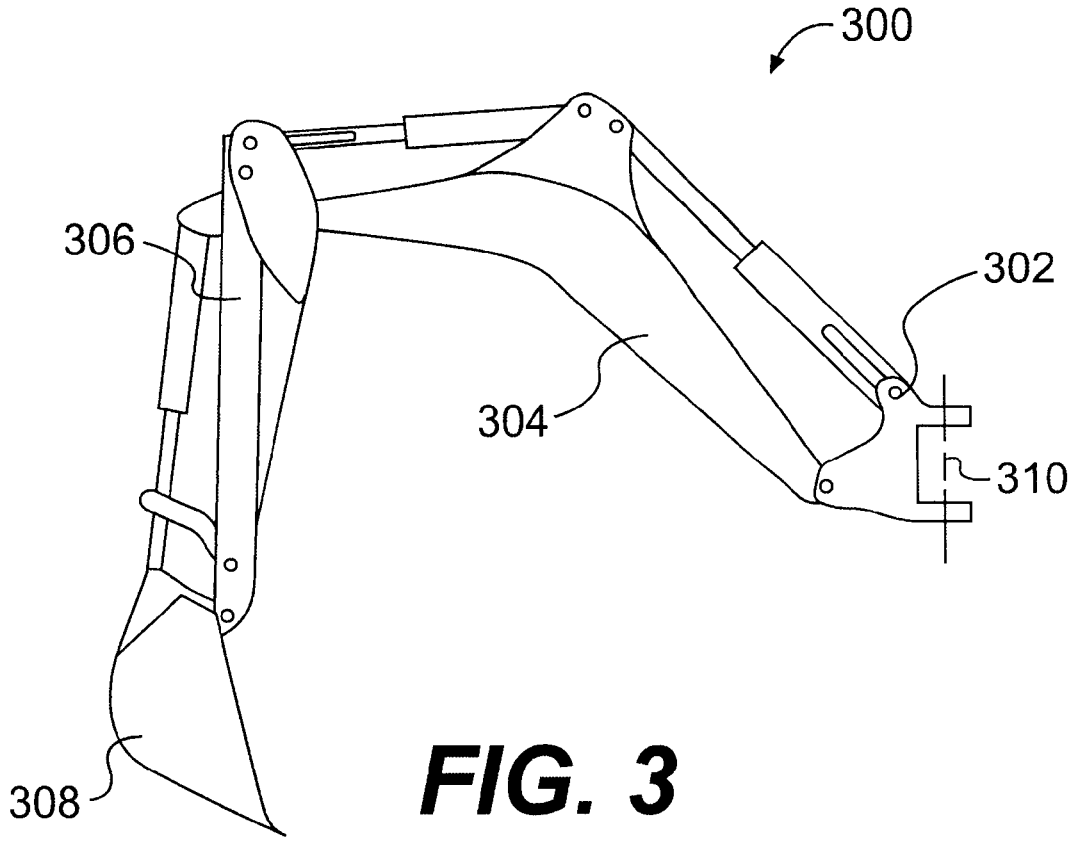
FIG. 3 is diagrammatic side view of a digging assembly for a work machine showing a swing axis.

A swing axis can be better seen with relation to the separate digging assembly illustrated in FIG. 3. FIG. 3 shows an embodiment of a digging assembly 300 including a swing frame 302, a boom member 304, a stick member 306, and a work implement 308. As shown, swing frame 302 pivots about swing axis 310.

Figure 4:
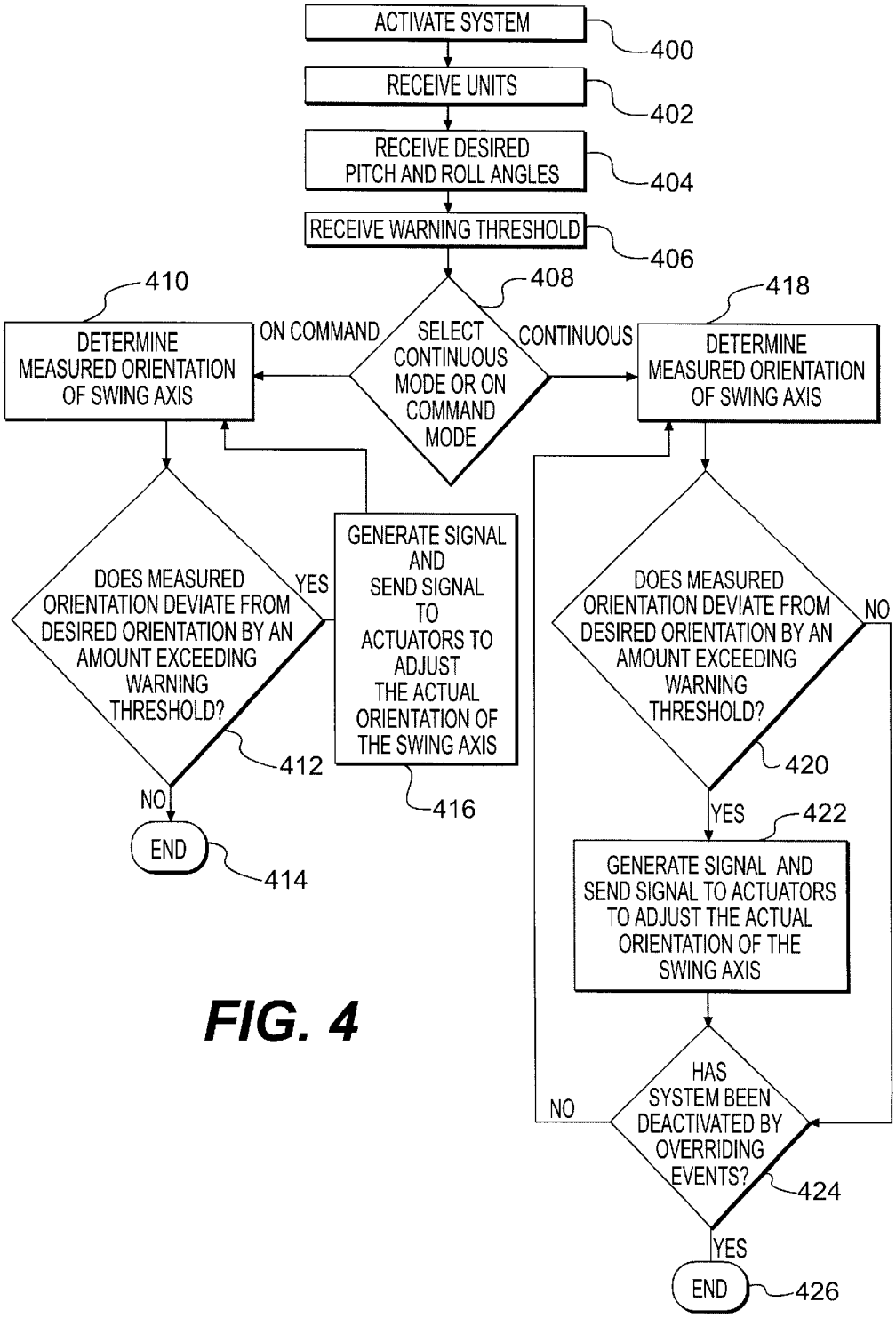
FIG. 4 is a flow diagram implementing an exemplary embodiment of the control system of the present invention.
Figure 5:
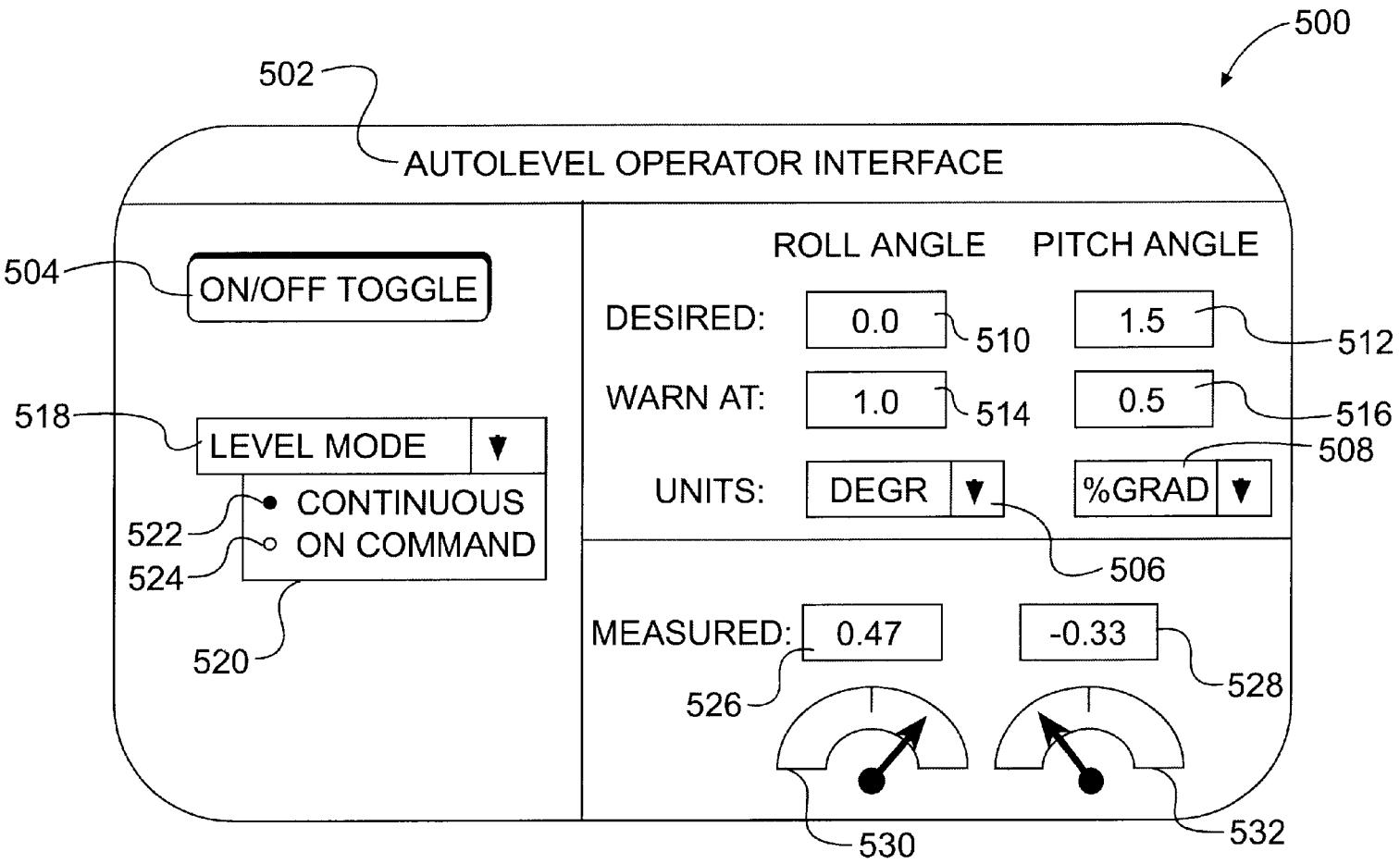
FIG. 5 is a front view of an operator interface of an exemplary embodiment of the present invention.

FIGS. 4 and 5 relate to an exemplary method and system for implementing the control system of the present invention. FIG. 4 is a flow chart showing an exemplary method of controlling the orientation of a swing axis of a work machine. FIG. 5 is an exemplary operator interface 500 for the control system. The control system may include a computer control module such as a computer processor with interphase and pre-programmed ROM configured to calculate and output displacement commands to change the orientation of a swing axis of a work machine. The control module may be, for example, any standard central processor in a computer, as would be apparent to one skilled in the relevant art.

The method and control system may be performed and used on a variety of work machines, and for illustrative purposes, will now be described as if being performed and used on work machine 100. As such, the control system could be used to control the orientation of swing axis 228 of work machine 100. Operator interface 500 (FIG. 5) may be placed within the operator's compartment 106 (in FIG. 1) and can be used and referenced by the operator during use of work machine 100. Operator interface 500 may include a title bar 502. Title bar 502 could have the title shown, "AutoLevel Operator Interface," or could have any other title that designates operator interface 500 as the leveling interface. Alternatively, operator interface 500 need not have a title or title bar at all.

In a step 400 of FIG. 4, an operator activates the system. An on/off toggle switch, shown at 504 in FIG. 5, may be used to turn the system on. If toggle switch 504 is toggled off, or the operator overrides the control system when the system is toggled on, work machine 100 may be leveled or oriented manually as the operator may desire.

In a step 402, the operator inputs the units that the operator wishes to operate with. The units may be inputted through a roll angle unit selector 506 and a pitch angle unit selector 508. Roll angle unit selector 506 and pitch angle unit selector 508 allow an operator to select the angle units used to orient swing axis 228. The units selected by roll angle unit selector 506 and pitch angle unit selector 508 are the units that are displayed to an operator in value displays, as is described further below.

Roll angle unit selector 506 and pitch angle unit selector 508 allow an operator to select units from an option list that may include, for example, degrees, radians and percent grade. Other units may be available as would be apparent to one skilled in the art. An operator may select different unit options using any method, including, for example, a drop down menu showing all the selectable units, a dial, or a menu configured to scroll through the unit choices, displaying one option at a time. It is contemplated that the units may be preset, or the system may be set to default to a particular unit option if the operator makes no selection.

In a step 404, the operator inputs a desired orientation of the swing axis. The operator may input the desired orientation of the swing axis as desired pitch and roll angles. A roll angle is the deviation of swing axis 228 from a vertical position in a side-to-side direction. Accordingly, roll angle is affected by the settings of the stabilizing arms 221, 222. For example, if first stabilizing arm 221 is actuated more than second stabilizing arm 222, thereby tilting work machine 100, the angle of tilt of swing axis 228 is the roll angle. A pitch angle is the deviation of swing axis 228 from a vertical position in a front-to-back direction. Accordingly, pitch angle is affected by the settings of the stabilizing arms 221, 222 in relation to the front of the work machine. As such, if both stabilizing arms 221, 222 are used to lift the rear of work machine 100, and the front end is not lifted, the angle of tilt of swing axis 228 in the front-to-back or back-to-front direction is the pitch angle. Likewise, if front work implement assembly 130 is used to lift or lower the front end of the work machine 100, the pitch angle is affected.

A desired roll angle display 510 and a desired pitch angle display 512 show the desired angle values that are inputted by an operator. The desired roll and pitch angles may be any roll and pitch angles at which the operator desires swing axis 228 to be oriented. The desired roll and pitch angles may be the angles required to orient swing axis 228 in a direction perpendicular to an angled surface, such as a slope to be graded, or may be any other desired angled direction. The desired roll angle and the desired pitch angle may be inputted into the control system using, for example, a numerical keypad, keyboard, mouse, dial, touch screen or any other input device, as would be apparent to one skilled in the relevant art. The control system may be configured to allow the operator to input either the desired angle of the swing axis or the angle of a work surface or desired slope. In the case where an angle of a surface is inputted, the control system may adjust the orientation of the swing axis relative to the inputted surface angle.

The operator may enter a warning threshold at a step 406. The warning threshold is the amount of allowed deviation of the desired orientation of the swing axis from a measured orientation of the swing axis. The measured orientation of the swing axis is the actual orientation of the swing axis, and is described further below. Operator interface 500 shows a roll angle warning threshold value display 514 and a pitch angle warning threshold value display 516. The roll and pitch angle warning threshold values set a range of tolerance of swing axis 228 in the roll and pitch directions, respectively.

If either the roll angle warning threshold value or the pitch angle warning threshold value is exceeded, an alarm may be activated to warn the operator of the deviation. The alarm could be either a visual alarm, such as a blinking light, or an audible alarm, such as a beeping alarm, or both, as would be apparent to one skilled in the art. The operator may either correct the orientation of swing axis 228 so that the deviation is within the set range, turn off the alarm and ignore the deviation, or reset the roll angle warning threshold value or the pitch angle warning threshold value at a higher value.

At a step 408, the operator selects a level mode from a level mode selector display 518. Level mode selector display 518 allows an operator to select from at least two different level modes. Level mode selector display 518 could be, for example, a drop down menu or a scrolling menu. Alternatively, level mode selector display 518 could continuously display all selectable level modes, thereby enabling an operator to easily determine which level mode is selected and which level modes are not selected. The embodiment shown displays level mode selector display 518 as a drop down menu. When the level mode selector display 518 is selected, drop down menu 520 appears showing selectable level mode indicators. In this embodiment, level mode indicators include a continuous mode indicator 522 and an on command mode indicator 524. This embodiment of operator interface 500 shows continuous mode indicator 522 as being selected.

When continuous mode is selected, the control module of the control system continuously reads and compares the desired roll and pitch angles to the measured roll and pitch angles, which are further described below. The control module continuously calculates a swing angle, based on the deviation of the measured pitch and roll angles from the desired pitch and roll angles, continuously updating the swing angle data. The swing angle is continuously outputted from the control module to activate actuators that operate to orient the swing axis of the swing frame.

When on command mode is selected, the control module of the control system reads and compares the desired roll and pitch angles of the swing axis to the measured roll and pitch angles of the swing axis, and calculates the swing angle. The control module outputs the swing angle to activate actuators to orient the swing axis to the desired orientation. When the measured orientation is substantially equal to the desired orientation, the control module stops sending swing angle data to the actuators. Accordingly, once the measured orientation of the swing axis is aligned with the desired orientation of the swing axis, the control module no longer operates to orient the swing axis. As such, the control module does not continuously update the orientation of the swing axis, but updates it only upon the operator's command.

Assuming the operator selected on command mode at step 408, a measuring device reads the actual, measured orientation of the swing axis at a step 410. This measured orientation could be read as a measured pitch angle and a measured roll angle. The measured roll angle is displayed in a measured roll angle display 526, and a measured pitch angle is displayed in a measured pitch angle display 528 on operator interface 500. The measured roll angle and the measured pitch angle represent the actual orientation of the swing axis of the work machine. The measured roll angle and the measured pitch angle may be measured by a mechanism, such as, for example, a dual-axis inclinometer or a gyroscope. However, any other appropriate measurement mechanism could be used, as would be apparent to one skilled in the relevant art. The angles may be converted to a digital form and outputted to operator interface 500 for display in measured roll angle display 526 and measured pitch angle display 528.

In the embodiment of FIGS. 1 and 2, wherein the swing frame 110 is connected to the frame structure 102, the measurement mechanism could be secured onto work machine 100 itself. In such an embodiment, the measured roll angle and measured pitch angle of work machine 100 will correspond to the roll angle and the pitch angle of swing axis 228. In an embodiment where the swing axis is rotatable independent of the orientation of the frame structure of the work machine, such as is described further below with reference to FIGS. 6–9, the measurement mechanism should be secured onto structure having a roll angle and a pitch angle that will correspond to the roll angle and the pitch angle of the swing axis, such as, for example, the swing frame of the digging assembly.

The measured pitch angle and the measured roll angle may also be shown in an analog form by analog roll angle indicator 530 and analog pitch angle indicator 532. In one embodiment, the measured roll angle display 526, measured pitch angle display 528, analog roll angle indicator 530, and analog pitch angle indicator 532 are all updated in real time. In another embodiment, the displays and indicators are updated only at intervals.

At a step 412, the control module determines whether the measured orientation of the swing axis deviates from the desired orientation by an amount exceeding the warning threshold amount. If the measured orientation of the swing axis does not deviate from the desired orientation by an amount exceeding the warning threshold amount, then the control module takes no corrective action, ending the control at a step 414.

In one exemplary embodiment, the control system may continue to monitor the deviation of the measured orientation of the swing axis from the desired orientation, and may activate the alarm when the deviation amount exceeds the warning threshold amount. Even then, the control module will not take corrective action when in on command mode.

If at step 412, the measured orientation of the swing axis does deviate from the desired orientation by an amount exceeding the warning threshold amount, then the control module generates a signal as a swing angle and sends the signal to actuators to adjust the actual pitch and roll angle of the swing axis, as at step 416. Accordingly, the measured orientation will be changed by the control module.

In one exemplary embodiment, the measured orientation is changed when the control module of the control system outputs the swing angle as a command or commands to actuators disposed on stabilizing arms. The actuators are activated by the commands to move the stabilizing arms to alter the actual orientation of the work machine so that it aligns with the desired orientation of the swing axis by an amount less than the warning threshold. The command or commands may also be provided to the actuators controlling the front work implement assembly.

The actuators may also include hydraulic cylinder controllers that are configured to receive the swing angle signal from the control module and output control signals based on the swing angle signal. Furthermore, the actuators may include cylinder displacement transducers, disposed on the stabilizing arms and/or the front work implement assembly, configured to send measurement signals to the control module. The cylinder displacement transducers may measure the actuator movement that displaces the stabilizing arms and/or the front work implement assembly.

The transducers may alternatively be angle transducers disposed on pivot points on the stabilizing arms and the front work implement assembly. The angle transducers may be configured to send measurement signals to the control module. The transducers may be linear, rotary or any other transducer type. Appropriate transducers may be obtained from, for example, MTS System Corp., of Eden Prairie, Minn.

After or during the time that the actual, and thus the measured, pitch and roll angle of the swing axis are adjusted at step 416, the measuring device takes new measurements of the adjusted pitch and roll values, at step 410. The control system continues to loop through steps 410, 412 and 416 until the measured orientation does not deviate from the desired orientation by an amount exceeding the warning threshold amount. The control system may then end at step 414.

If the operator selects continuous mode at step 408, the control system reads an actual, measured orientation of the swing axis, at a step 418. This measured orientation could be read as a measured pitch angle and a measured roll angle as described above.

At a step 420, the control module determines whether the measured orientation of the swing axis deviates from the desired orientation by an amount exceeding the warning threshold amount. If the measured orientation of the swing axis does not deviate from the desired orientation by an amount exceeding the warning threshold amount, then the control module takes no corrective action at that time. If at step 420, the measured orientation of the swing axis does deviate from the desired orientation by an amount exceeding the warning threshold amount, then the control module generates a signal as a swing angle and sends the signal to actuators to adjust the actual pitch and roll angles of the swing axis, as shown at a step 422. Accordingly, the measured orientation will be changed by the control system by sending signals as described above with reference to the on command mode.

When in continuous mode, the control module reads and calculates the swing angle in real time, continuously updating the swing angle data. The swing angle is the angle of correction required to align the measured angles to the desired angles. Depending on the system used, the swing angle may not be an actual angle, but may merely represent correction data that would align the measured swing axis orientation to the desired swing axis orientation. The swing angle is outputted from the control module to activate actuators that operate to orient swing axis 228 of the swing frame 110.

Whether or not the measured orientation deviates from the desired orientation by an amount exceeding the established threshold at step 420, and after or during the time that the actual, and thus the measured, pitch and roll angles of the swing axis are adjusted at step 422, the automatic control system can be disrupted by a number of deactivating events. If any one of the deactivating events occur, the control system is disabled, and the work machine returns to full manual control. Accordingly, the automatic control may continue until the conditions for disruption override the automatic control at any time, ending the automatic control. At a step 424, the control system confirms that no overriding events have occurred regardless of step 420. As would be obvious to one skilled in the art, the system need not positively confirm that any of the overriding events have occurred, but will proceed with automatic control until one of the overriding events do occur. Examples of overriding events include switching the control system to off, changing the selected level mode, manually operating the controls of the controlled actuators, placing the machine in gear, and powering off the machine. If any overriding event has occurred, the control system ends control at a step 426.

If any deactivating events have not occurred, then the system returns from step 424 to step 418, and the control module determines the measured orientation of the swing axis. The control system will continue to loop when in continuous mode until an overriding event occurs.

In one exemplary embodiment, the control module of the control system does not activate the actuators to adjust the swing angle until after the warning threshold value is exceeded. Therefore, corrective action is taken at less frequent intervals than when the control system corrects for any deviation of the measured orientation from the desired orientation. In another exemplary embodiment, a preprogrammed activation threshold is included in the control system, thereby allowing activation only when the orientation of swing axis 228 deviates from the desired orientation by a minimum amount, such as, for example 0.25 degrees.

In one exemplary embodiment, operator interface 500 includes a deviation value display (not shown). The deviation value display shows the difference of the measured orientation from the desired orientation. More specifically, the deviation value display shows the difference between the measured roll angle from the desired roll angle and the measured pitch angle from the desired pitch angle.

A second exemplary structural embodiment for orienting a swing axis is described with reference to FIGS. 6–9. The second exemplary embodiment includes a frame assembly that allows the swing axis to be oriented independent of the orientation of the frame of the work machine. In the second exemplary embodiment, the swing axis is adjusted using actuators in a pitch and roll frame assembly. The method and system described with reference to FIGS. 4 and 5 may be similarly applied to automatically orient the swing axis of the second exemplary embodiment.

Figure 6:
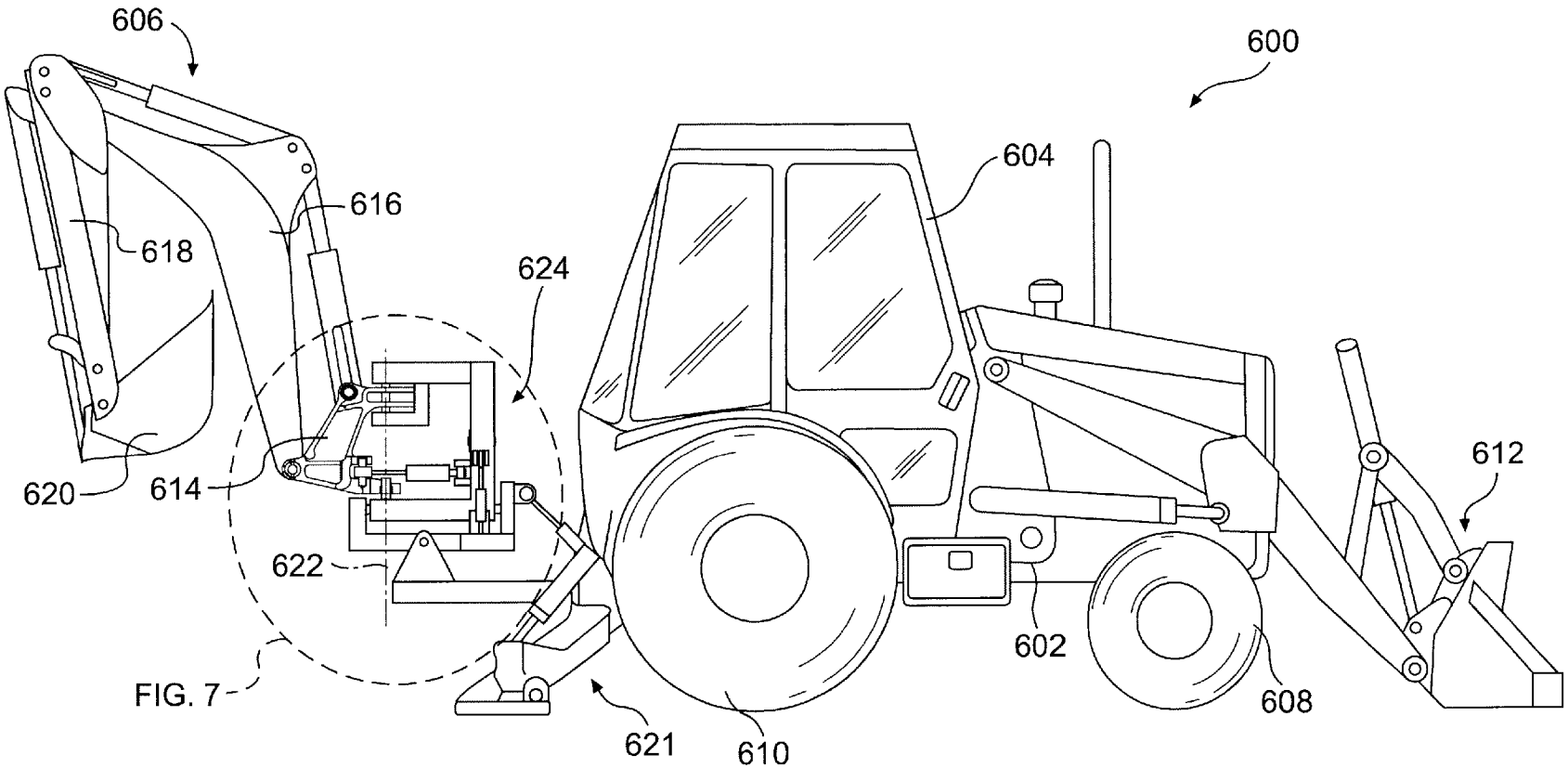
FIG. 6 is a diagrammatic side view of a second exemplary embodiment of a work machine according to the invention.

With reference to FIG. 6, a work machine 600 includes a frame structure 602, an operator's compartment 604, and a digging assembly 606 disposed at the rear of the work machine 600. Work machine 600 includes front wheels 608 and rear wheels 610 and may further include a front work implement assembly 612.

Digging assembly 606 includes a swing frame 614, a boom member 616, a stick member 618, and a work implement 620, and may operate using actuators configured as is known in the art. Work machine 600 may also include a stabilizing system 621 including stabilizing arms, similar to that described with reference to FIG. 1.

A multi-degree-of freedom frame assembly 624 may be disposed at the rear of work machine 600 between frame structure 602 and digging assembly 606. Frame assembly 624 is shown circled in dashed lines in FIG. 6. Frame assembly 624 allows a swing axis 622 to have rotational ability in the pitch direction and the roll direction independent of the work machine frame. As stated above, this orientation may be accomplished through the exemplary control system described in connection with FIGS. 4 and 5.

Figure 7:
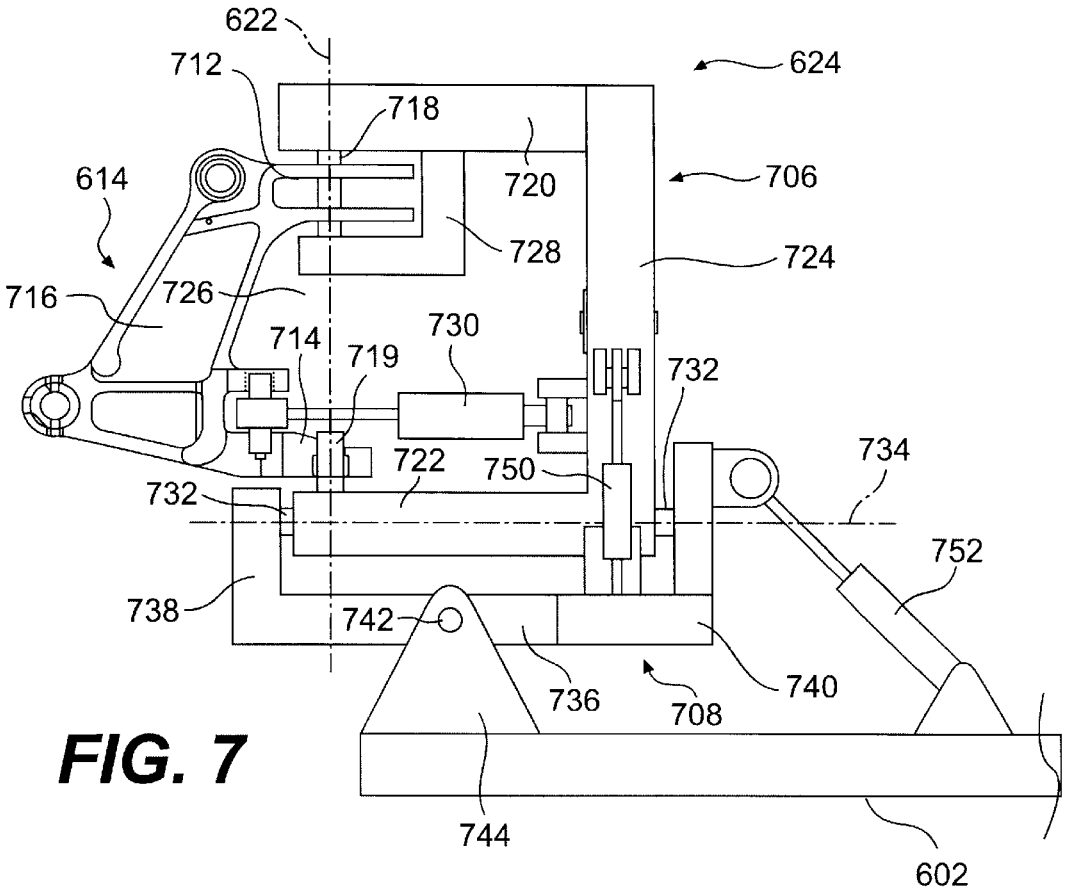
FIG. 7 is an enlarged side view of a portion of the second exemplary embodiment of the control system of the present invention shown in dotted lines in FIG. 6.
Figure 8:
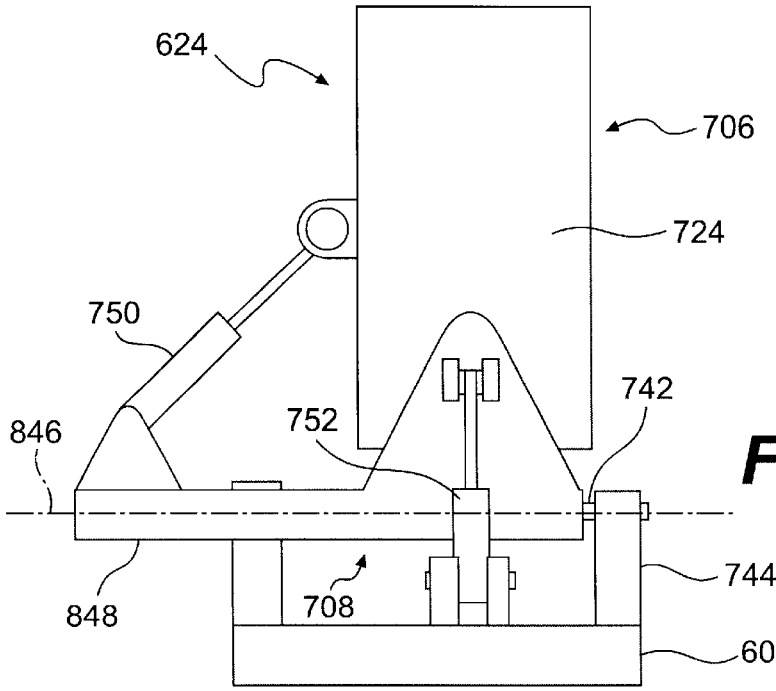
FIG. 8 is a front view of the assembly of FIG. 7.

Frame assembly 624 is described in greater detail with reference to FIGS. 7–9. As shown in FIG. 7, frame assembly 624 includes swing frame 614 pivotally connected to a roll frame 706. Swing frame 614 may be part of a digging assembly, as described with reference to FIGS. 1–3. Swing frame 614 pivots about swing axis 622. Roll frame 706 is rotatably connected to a pitch frame 708. Pitch frame 708 is supported by or connected to frame structure 602 of a work machine.

Swing frame 614 includes a top swing arm 712 and a bottom swing arm 714 extending from a main body 716. Top and bottom swing arms 712, 714 each include through holes, which are aligned and formed to fit top and bottom swing pins 718, 719 about which swing frame 614 may rotate.

Roll frame 706 may be, generally, a C-shaped frame structure having a top portion 720, a bottom portion 722, a closed side 724, and an open side 726. Open side 726 is configured to receive top and bottom swing arms 712, 714 of swing frame 614. Roll frame 706 includes openings for receiving and securing swing pins 718, 719. Accordingly, swing frame 614 may rotate about swing axis 622 when connected to roll frame 706. Roll frame 706 may include a connection bar support 728 for securing top swing arm 712 into roll frame 706. Connection bar support 728 may be a right-angled support that extends from top portion 720 of roll frame 706 toward open side 726 of roll frame 706. Top swing arm 712 of swing frame 614 fits between top portion 720 of roll frame 706 and connection bar support 728. Top swing pin 718 extends from top portion 720 of roll frame 706, through top swing arm 712, and into connection bar support 728 of roll frame 706, securely attaching swing frame 614 to roll frame 706.

Bottom portion 722 of roll frame 706 includes an opening for receiving bottom swing pin 719, thereby aligning the opening in bottom portion 722 of roll frame 706 with the through hole in the bottom swing arm 714, securely attaching bottom swing arm 714 of swing frame 614 to roll frame 706.

Figure 9:
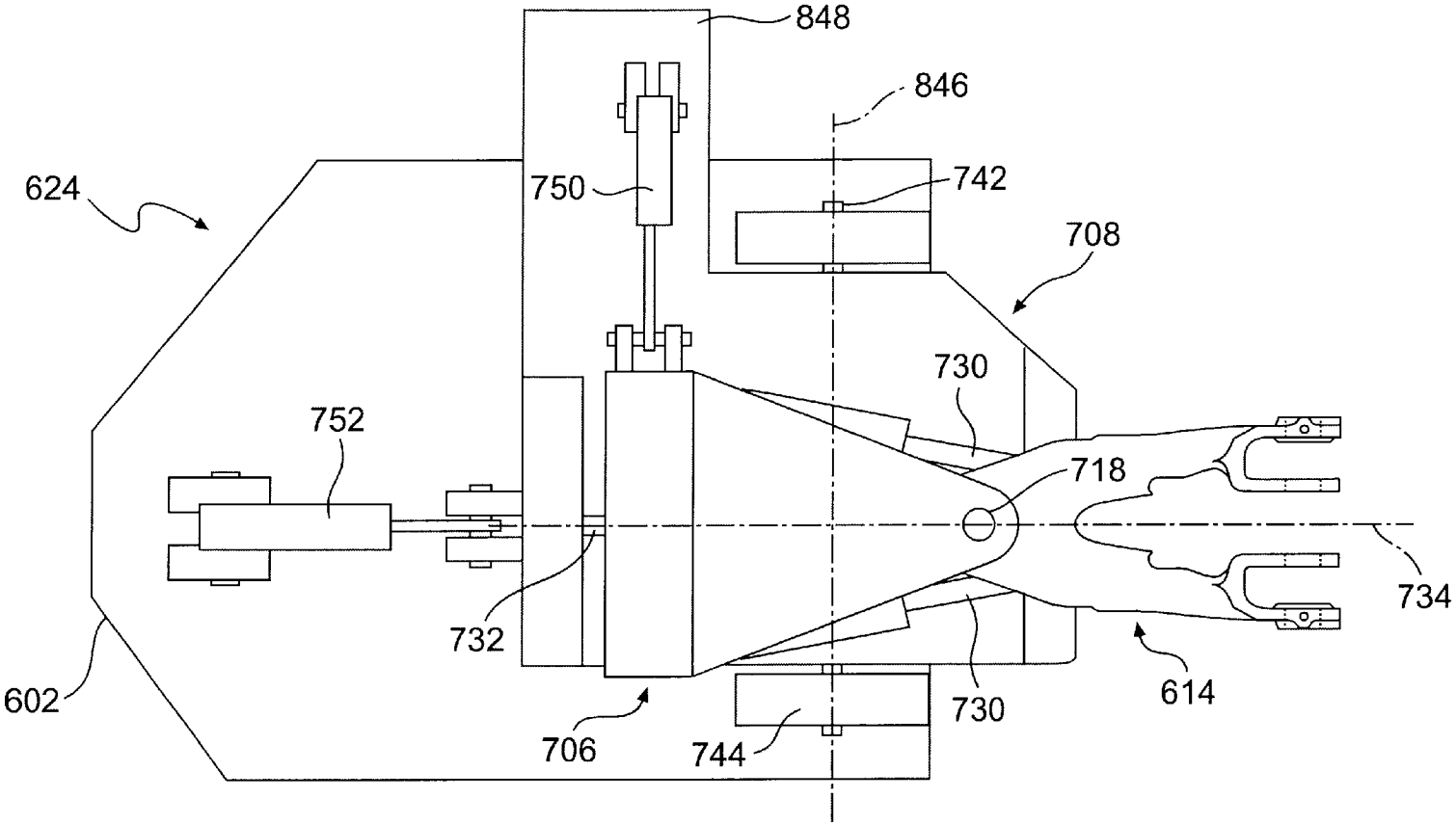
FIG. 9 is a top view of the assembly of FIG. 7.

Actuators 730, best seen in FIGS. 7 and 9, extend from closed side 724 of roll frame 706 to swing frame 614. Actuators 730 control the rotation of swing frame 614 about swing axis 622. In this exemplary embodiment, two actuators are used to control the rotation of swing frame 614 about swing axis 622. However, more or less than two actuators could be used, as would be apparent to one skilled in the relevant art.

Roll frame 706 is rotatably connected to pitch frame 208 through a connecting structure, such as, for example, roll pins 732. Roll pins 732 form a roll axis 734, about which roll frame 706 may rotate. The connecting structure could be any structure that connects the roll frame to the pitch frame and that allows roll frame 706 to rotate about roll axis 734.

Pitch frame 708 is a three-sided structure open at the top, as oriented in FIG. 7. The bottom portion 722 of roll frame 706 fits within the open top of pitch frame 708, as seen in FIG. 7. Pitch frame 708 includes a bottom section 736, a first wall 738 disposed on the side adjacent to swing frame 614, and a second wall 740 adjacent to closed side 724 of roll frame 706. First wall 738 and second wall 740 cooperate with roll pins 732 to support roll frame 706.

Pitch frame 708 is connected to frame structure 602 by a connecting structure, such as, for example, pitch pins 742. Pitch pins 742 form a pitch axis 846 about which pitch frame 708 may rotate. The connecting structure could be any structure that connects the pitch frame 708 to the frame structure 602 and that allows pitch frame 708 to rotate about pitch axis 846.

Bottom section 736 of pitch frame 708 includes an extension 848 that extends beyond the width of roll frame 706 (best seen in FIG. 9). Extension 848 is used to support a roll actuator 750. Roll actuator 750 extends from closed side 724 of roll frame 706 to extension 848 of pitch frame 708, in a direction perpendicular to, but not crossing, roll axis 734. Roll actuator 750 controls the rotation of roll frame 706 about roll axis 734. Accordingly, to orient swing axis 622 in a roll direction, roll actuator 750 is activated to rotate roll frame 706 about roll axis 734, thereby rotating swing axis 622, which is fixed to roll frame 706, in the roll direction.

Likewise, a pitch actuator 752 controls the rotation of pitch frame 708 about pitch axis 846. Pitch actuator 752 extends from second wall 740 of pitch frame 708 to frame structure 602 in a direction perpendicular to, but not crossing, pitch axis 846. Accordingly, to rotate swing axis 622 in a pitch direction, pitch actuator 752 is activated to rotate pitch frame 708 about pitch axis 846, thereby rotating roll frame 706, swing frame 614, and swing axis 622 in the pitch direction.

Various alternative embodiments to the exemplary structure of frame assembly 624 are contemplated. For example, in one exemplary embodiment, the swing frame may be directly connected to the pitch frame and the roll frame may be directly connected to the machine frame structure. In another exemplary embodiment, the pitch actuator and/or the roll actuator may be connected to the digging assembly.

The control system described with reference to FIGS. 4 and 5 may be used with the pitch and roll frames described above. In this embodiment, the control module of the control system compares an inputted desired orientation of the swing axis to a measured orientation of the swing axis and calculates a swing angle, as described with reference to FIGS. 4 and 5. The measuring device is disposed on structure of the work machine that will correspond to the swing axis, such as the swing frame. The swing angle may be outputted from the control module to activate the pitch and roll actuators of the frame assembly 624 to orient the swing axis 622 to the desired orientation.

Industrial Applicability

When digging or grading with a work machine having a work implement, it is often useful to control the orientation of the swing axis of the work implement and its associated digging assembly. For instance, by orienting the swing axis in a direction perpendicular to a desired grading surface, the digging edge of the work implement is parallel to the plane of the digging surface through the swinging range of the digging assembly. Therefore, a planar working surface may be obtained when grading, and saw-tooth ridges of material are avoided. Furthermore, orienting the swing axis in a direction perpendicular to a desired surface when digging a trench results in a trench having smooth walls, rather than jagged walls.

The present invention is an automatic control system that allows an operator to input a desired orientation of the swing axis of a work machine. The system then automatically orients the swing axis to the desired orientation. The control system may be implemented to adjust the orientation of the work machine frame if the swing axis of the digging assembly is dependent upon the machine frame orientation. Such a work machine is shown in the FIG. 1 embodiment. Alternatively, the control system may be implemented to adjust the orientation of a swing axis independent of the machine frame. An exemplary embodiment of this implementation is shown in FIG. 6.

The control system enables an operator to easily align the swing axis perpendicular to a slope or at any other desirable orientation. The ease with which an operator may set and orient the swing axis position increases operator efficiency because the operator is not required to manually adjust the settings by trial and error.

Additionally, over the course of a digging project, the movements of the digging assembly may slightly displace the work machine, such that the initial angle setting of the swing axis may not be maintained. The control system enables an operator to maintain the desired swing axis angle without constantly manually adjusting the angle. As such, the system is particularly advantageous for inexperienced operators or fatigued operators, who may not be constantly aware of the orientation of the swing axis. As an additional precaution, the present invention notifies an operator if the angle of the swing axis begins to change from its initially set orientation.

The present invention is adaptable to a variety of work machines where maintaining a swing axis at a specific orientation (e.g. perpendicular to a work surface) may be desirable. For instance, the present invention may be useful on excavators, front shovels, material handlers, or any work machine having a swing axis about which a work implement rotates.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A control system for orienting a swing axis of a work machine having a swing frame and a frame structure, the system comprising:

an operator interface configured to receive operator inputs, wherein the operator inputs represent a desired orientation of the swing axis of the swing frame;

a sensor assembly configured to determine an actual orientation of the swing axis of the swing frame; and a controller configured to compare the desired orientation to the actual orientation of the swing axis to determine a swing angle, the controller being adapted to output the swing angle.

2. The control system of claim 1, wherein the desired orientation of the swing axis is based on a desired pitch angle and a desired roll angle.

3. The control system of claim 1, further including a pair of stabilizing arms that are actuated according to the swing angle, wherein the stabilizing arms alter the orientation of the work machine to orient the swing axis in the desired orientation.

4. The control system of claim 3, further including:

cylinder displacement transducers disposed on the pair of stabilizing arms, wherein the cylinder displacement transducers are configured to send a measurement signal to the controller indicative of the position of the pair of stabilizing arms; and a hydraulic cylinder controller configured to receive the swing angle from the controller and adjust the position of the pair of stabilizing arms.

5. The control system of claim 3, further including:

angle transducers disposed at pivot points on the pair of stabilizing arms, wherein the angle transducers are configured to send a measurement signal to the controller indicative of the position of the pair of stabilizing arms; and a hydraulic cylinder controller configured to receive the swing angle from the controller and adjust the position of the pair of stabilizing arms.

6. The control system of claim 1, wherein the operator interface includes a display configured to show the actual orientation as a measured roll angle and a measured pitch angle, and configured to show the desired orientation as a desired roll angle and a desired pitch angle.

7. The control system of claim 1, further including an alarm for warning an operator when the actual orientation deviates from the desired orientation by a set amount.

8. The control system of claim 1, further including:

a roll frame;

a pitch frame connected to the roll frame, wherein the roll frame and the pitch frame are disposed between the frame structure and the swing frame, such that the swing axis of the swing frame rotates independent of the work machine frame structure in a pitch direction and in a roll direction;

a first actuator disposed between the pitch frame and the roll frame; and a second actuator disposed between the machine frame structure and the pitch frame, wherein the first and second actuators are configured to move the roll and pitch frames, respectively, based on the swing angle.

9. A method of orienting a swing axis of a work machine having a swing frame and a frame structure, the method comprising:

entering operator inputs into an operator interface, wherein the operator inputs represent a desired orientation of the swing axis of the swing frame;

sensing the actual orientation of the swing axis;

comparing the desired orientation to the actual orientation of the swing axis to determine a swing angle; and adjusting the swing axis based on the swing angle to obtain the desired orientation of the swing axis.

10. The method of claim 9, wherein adjusting the swing axis includes adjusting the orientation of the frame structure of the work machine.

11. The method of claim 10, wherein adjusting the swing axis includes activating a pair of stabilizing arms based on the swing angle, the pair of stabilizing arms being connected to the frame structure such that the frame structure is displaced by the stabilizing arms to orient the swing axis to the desired orientation.

12. The method of claim 9, wherein the operator inputs include a desired roll angle and a desired pitch angle.

13. The method of claim 9, wherein the operator inputs include a desired roll angle and a desired pitch angle, and the actual orientation includes a sensed roll angle and a sensed pitch angle, wherein the sensed roll angle and the sensed pitch angle are updated in real time to reflect changes in the sensed roll angle or the sensed pitch angle.

14. The method of claim 9, wherein adjusting the swing axis includes adjusting the orientation of the swing frame independent of the frame structure of the work machine.

15. The method of claim 14, further including:

activating a first actuator based on the swing angle to move the swing axis of the swing frame in a roll direction, wherein the swing axis of the swing frame moves independent of the frame structure in the roll direction; and activating a second actuator based on the swing angle to move the swing axis of the swing frame in a pitch direction, wherein the swing axis of the swing frame moves independent of the frame structure in the pitch direction.

16. The method of claim 15, wherein the desired orientation of the swing axis is a direction substantially perpendicular to a work surface.

17. The method of claim 15, wherein the first actuator extends from a roll frame to a pitch frame, and the second actuator extends from the pitch frame to the frame structure.

18. A control system for orienting a swing axis of a work machine having a swing frame and a frame structure, the system comprising:

an operator interface configured to receive operator inputs, wherein the operator inputs represent a desired orientation of the swing axis;

a device configured to determine a measured orientation of the swing axis;

a control module configured to compare the desired orientation to the measured orientation of the swing axis to determine a swing angle, the control module being adapted to output the swing angle; and actuators that are actuated according to the swing angle, wherein the actuators are configured to adjust the work machine frame to thereby orient the swing axis to the desired orientation.

19. The control system of claim 18, wherein the operator inputs include a desired pitch angle and a desired roll angle, and the desired pitch angle and the desired roll angle are angles that orient the swing axis in direction substantially perpendicular to a work surface.

20. The control system of claim 18, further including:

a pair of stabilizer arms configured to be operated by the actuators;

cylinder displacement transducers disposed on the pair of stabilizer arms, wherein the cylinder displacement transducers are configured to send measurement signals to the control module indicative of the position of the stabilizer arms; and an actuator controller configured to receive the swing angle from the control module and adjust the position of the stabilizer arms.

21. The control system of claim 18, further including:

a pair of stabilizer arms configured to be operated by the actuators;

angle transducers disposed at pivot points on a pair of stabilizers, wherein the angle transducers are configured to send measurement signals to the control module indicative of the position of the stabilizer arms; and an actuator controller configured to receive the swing angle from the control module and adjust the position of the stabilizer arms.

22. The control system of claim 18, wherein the operator interface includes a display configured to show the measured orientation as a measured roll angle and a measured pitch angle, and configured to show the desired orientation as a desired roll angle and a desired pitch angle.

23. The control system of claim 18, further including an alarm configured to warn an operator when the measured orientation deviates from the desired orientation by a set amount.

24. A method of orienting a swing axis of a work machine having a swing frame and a frame structure, the method comprising:

receiving operator inputs in an operator interface, wherein the operator inputs represent a desired orientation of the swing axis;

determining a measured orientation of the swing axis;

comparing the desired orientation to the measured orientation of the swing axis to determine a swing angle;

outputting the swing angle; and activating actuators according to the swing angle, wherein the actuators adjust the work machine frame to thereby orient the swing axis to the desired orientation.

25. The method of claim 24, wherein receiving operator inputs includes receiving a desired pitch angle and a desired roll angle, and the desired pitch angle and the desired roll angle are angles that orient the swing axis in direction substantially perpendicular to a work surface.

26. The method of claim 24, further including:

receiving measurement signals from cylinder displacement transducers disposed on the actuators; and sending the swing angle to an actuator controller to adjust the actuators.

27. The method of claim 24, further including:

displaying the measured orientation of the swing axis as a measured roll angle and a measured pitch angle; and displaying the desired orientation of the swing axis as a desired roll angle and a desired pitch angle.

28. The method of claim 24, further including updating the measured orientation in real time.

29. A control system for orienting a swing axis of a work machine having a machine frame structure, a swing frame, and a frame assembly connecting the machine frame structure to the swing frame, the system comprising:

an operator interface configured to receive operator inputs, wherein the operator inputs represent a desired orientation of the swing axis;

a device configured to determine a measured orientation of the swing axis;

a control module configured to compare the desired orientation to the measured orientation of the swing axis to determine a swing angle, the control module being adapted to output the swing angle; and actuators that are actuated according to the swing angle, wherein the actuators are configured to adjust the frame assembly independent of the machine frame structure to thereby orient the swing axis to the desired orientation.

30. The control system of claim 29, wherein the frame assembly includes:

a roll frame connected to the swing frame; and a pitch frame connected to the roll frame and the machine frame structure such that the swing axis of the swing frame rotates in a pitch direction and in a roll direction.

31. The control system of claim 30, further including:

first and second actuators configured to move the roll and pitch frames respectively, based on the swing angle.

32. The control system of claim 31, wherein the first actuator is disposed between the pitch frame and the roll frame, and the second actuator is disposed between the machine frame structure and the pitch frame.

33. A method of orienting a swing axis of a work machine having a machine frame structure, a swing frame, and a frame assembly connecting the machine frame structure to the swing frame, the method comprising:

receiving operator inputs in an operator interface, wherein the operator inputs represent a desired orientation of the swing axis;

determining a measured orientation of the swing axis;

comparing the desired orientation to the measured orientation of the swing axis to determine a swing angle;

outputting the swing angle; and activating actuators according to the swing angle, wherein the actuators adjust the frame assembly independent of the machine frame structure to thereby orient the swing axis to the desired orientation.

34. The method of claim 33, wherein activating actuators includes:

activating a first actuator to move the swing axis of the swing frame in a roll direction; and activating a second actuator to move the swing axis of the swing frame in a pitch direction.

35. The method of claim 34, wherein the first actuator extends from a roll frame to a pitch frame, and the second actuator extends from the pitch frame to the machine frame structure.

* * * * *